US006105590A

United States Patent [19]

Martin et al.

[11] Patent Number: 6,105,590

[45] Date of Patent: Aug. 22, 2000

[54] METHOD AND ARRANGEMENT FOR REMOVING DEPOSITS IN AND ON FEED NOZZLES OR FEED PIPES OF FIRING INSTALLATIONS

[75] Inventors: Johannes Martin, Munich; Peter Spichal, Greifenberg, both of Germany

[73] Assignee: Martin GmbH fur Umwelt-und Energietechnik, Munich, Germany

[21] Appl. No.: 09/055,081

[22] Filed: Apr. 3, 1998

[30] Foreign Application Priority Data

Apr. 24, 1997 [DE] Germany ..... 197 17 378

[51] Int. Cl.[7] ..... B08B 9/00; B08B 9/093; B08B 3/00

[52] U.S. Cl. ..... 134/22.12; 134/22.18; 134/166 R; 134/167 R; 134/168 R

[58] Field of Search ..... 134/22.12, 22.18, 134/166 R, 167 R, 168 R; 122/290, 292

[56] References Cited

U.S. PATENT DOCUMENTS

| | | | |
|---|---|---|---|
| 4,508,577 | 4/1985 | Conn et al. | 134/1 |
| 4,859,249 | 8/1989 | Valentini | 134/22.18 |
| 5,160,548 | 11/1992 | Boisture | 134/7 |
| 5,512,140 | 4/1996 | Rutan . | |
| 5,670,026 | 9/1997 | Rutan | 203/4 |
| 5,674,323 | 10/1997 | Garcia | 134/1 |
| 5,735,964 | 4/1998 | Amuny | 134/8 |
| 5,833,725 | 11/1998 | Dehn et al. | 55/302 |
| 5,833,767 | 11/1998 | Magnin et al. | 134/22.12 |
| 5,851,580 | 12/1998 | Amberg et al. | 427/8 |

FOREIGN PATENT DOCUMENTS

| | | |
|---|---|---|
| 741701 | 8/1943 | Germany . |
| 81 35 474 | 3/1982 | Germany . |
| 4311009A1 | 10/1994 | Germany . |
| 56-206226 | 6/1983 | Japan . |
| 56-208313 | 6/1983 | Japan . |
| 56-214070 | 6/1983 | Japan . |

OTHER PUBLICATIONS

Prof. Dr. Ing. W. Schultes, *Energie*, Kohle–Treibstoffe–Gas–Strom–Wasserkraft, Jan. 15, 1951.

*Primary Examiner*—Randy Gulakowski
*Assistant Examiner*—Yolanda E. Wilkins
*Attorney, Agent, or Firm*—Wood, Herron & Evans, L.L.P.

[57] ABSTRACT

In order to remove deposits in feed nozzles (20), which serve to recycle exhaust gas into the furnace of a firing installation, a lance (27) can be inserted into the feed nozzles (20) and is held in such a way as to be displaceable in its longitudinal direction. The lance (27) has a nozzle head (28) at its front end for the spraying of water and is connected at its rear end to a valve device (29), which can be adjusted via a control device (32) with regard to the water quantity, the water pressure and the opening and closing times. By means of the lance (27), water is sprayed in a finely distributed manner onto deposits (34) in the interior of the feed nozzle (20), as a result of which the water penetrates into these deposits and causes these deposits to be blasted off due to the development of vapour.

24 Claims, 3 Drawing Sheets

Figure 1:
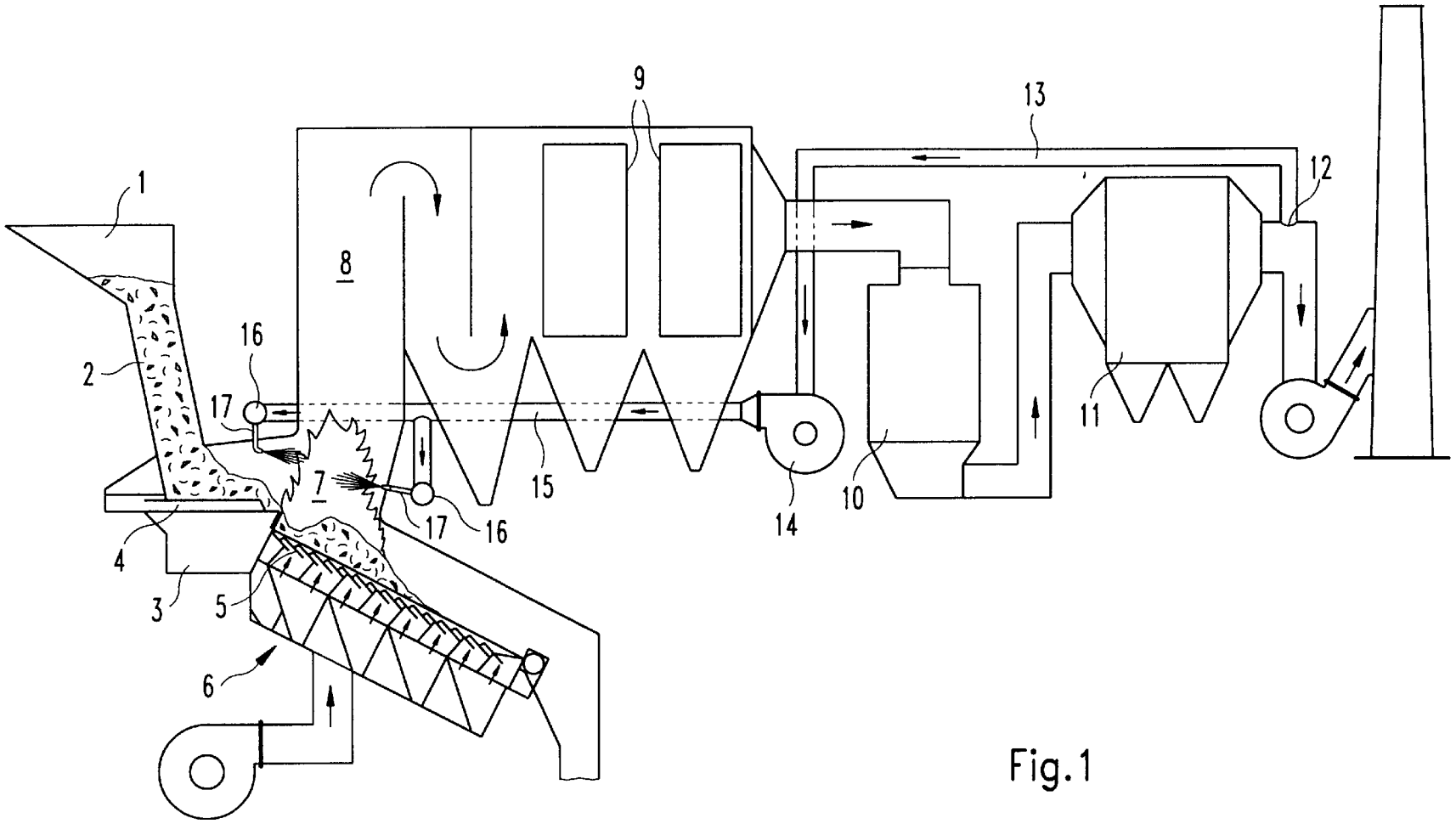

METHOD AND ARRANGEMENT FOR REMOVING DEPOSITS IN AND ON FEED NOZZLES OR FEED PIPES OF FIRING INSTALLATIONS

The invention relates to a method for removing deposits in and on feed nozzles or feed pipes of firing installations, in which these deposits collect from recirculated exhaust gas, which is fed again to a furnace, a liquid or vaporous medium being applied to the deposits. The invention also relates to an arrangement for carrying out the method.

In firing installations, in particular in those in which waste products are burned, exhaust gas is drawn off for various reasons after a certain cooling-down phase (e.g. in a steam generator) or the exhaust gas of the furnace is drawn off from regions suitable for this and is fed again to the furnace via feed nozzles or feed pipes. The reasons for the recycling of exhaust gas may be to attain a high thermal efficiency of the installation, to generate especially high turbulence in the region of the secondary combustion zone, to utilize the oxygen still present in the exhaust gas, and to control the oxygen content in the secondary combustion zone. In this case, the exhaust gas is preferably drawn off downstream of an exhaust-gas cleaning system, e.g. the dedusting device, arranged downstream of the utilization of heat. However, it may also be removed from the rear region of the furnace, in which fuel which is already largely burnt out is located and the exhaust gases therefore still have a relatively high proportion of oxygen.

In such a mode of operation, it has now been found that the feed nozzles or feed pipes, which can also serve to feed secondary air, gradually become obstructed in the region of their outlet opening by deposits which originate from the exhaust gas, so that these deposits have to be removed at certain time intervals in order to restore the free outlet cross-section of the feed nozzles or feed pipes. Hitherto, the removal of the deposits has been effected mechanically by knocking or breaking them off by means of appropriate rods, which is not only laborious and time-consuming but is also unsatisfactory because the deposits, which adhere extremely vigorously, can be removed completely only from the furnace, which requires the installation affected to be shut down and cooled down. These deposits occur in the region of the orifice of the feed nozzles or feed pipes both in the interior of these feed nozzles or feed pipes and on the outer surfaces directly adjoining the orifice. They are caused by the intense heat irradiation from the furnace, this heat irradiation leading to vitrification of the deposits in the part of the caking facing the firing and thus to a particularly effectively adhering and resistant structure, which can only be destroyed with difficulty in a mechanical manner.

For the cleaning of boiler tubes, it is known from the German journal "Energie", 1951, No. 1 to spray water by means of a lance onto tube surfaces until the latter cool down, after which an adjacent region is sprayed in order to then return again to the first region when the latter has heated up again after the cooling down. Crack formations, which lead to flaking of the contaminants, are said to occur here. Furthermore, it is known from this journal to treat heating surfaces by means of a water-vapour/ammonia-vapour mixture. In this case, the feed pipes cannot be inserted into the boiler until the same has cooled down to a certain extent, which requires a corresponding interruption in operation. In addition, chemical additions to the steam are serious on account of possible corrosion damage.

It is known from German Patent 741 701 to remove, by means of a water-injection device, deposits which collect above secondary-air discharge nozzles by cold water jets being sprayed onto the hot slag in order to remove the hot slag from the walls as a result of the quenching. This type of removal of the slag formation is not very effective, since only a few surface cracks are produced by the quenching effect, for which reason this operation has to be repeated frequently until flaking of the slag can be achieved. The reason for this expensive measure is due to the fact that the deposits formed consist of slag which is vitrified on the surface and does not allow water into the interior without crack formation. Only the frequent interaction between heating and quenching leads to crack formation and removal of these deposits. This procedure also has the disadvantage that there is a high stress risk for boiler-tube walls or the ceramic linings on account of the interactions referred to.

The object of the invention is to provide a method and an arrangement, by means of which it is possible to remove these deposits virtually completely in a simple manner during the normal operation of the firing installation.

This object is achieved according to the invention in that the liquid medium is sprayed in droplet form onto the deposits, in that the medium is applied to the deposits in the direction of flow of the exhaust gases inside the feed nozzles or feed pipes starting with that margin of the deposits which is the front margin in the direction of flow of the exhaust gases inside the feed nozzles or the feed pipes.

By the introduction of a liquid medium, in particular water, into the feed nozzles or feed pipes, specifically by the application of this medium to the deposits in the direction of flow of the exhaust gases inside the feed nozzles or feed pipes, the application being started at the front margin of the deposits, the deposits are removed in a short time, in which case the cleaning action, according to the tests carried out hitherto and the findings obtained in the process, consists in the fact that in the interior of the feed nozzles or feed pipes the liquid medium penetrates rapidly into the interior of the deposits. Due to the heat effect from the furnace or from the circulated gas flow, this water, which has penetrated into the pores of the hygroscopic deposits, vaporizes explosively. The deposits are blasted open from the inside. In this way, the deposits are removed not only on the inner wall of the feed nozzles or the feed pipes but also around the orifice region to the outside. This is due to the fact that the water, on account of the blasting of the deposits, which starts from the inner region of the feed nozzle or the feed pipe, strikes rough and thus porous surface portions of the deposits, which lie in the interior of the deposits already formed and are therefore not vitrified, as is the case on the outer surface of the deposits which are located on the outer periphery of the feed nozzles or feed pipes and which are directly exposed to the heat irradiation from the furnace. The blasting-off action, starting from the inner region of the feed nozzle or the feed pipe, therefore continues up to the orifice and also around the orifice to the outside of the feed nozzles or the feed pipes. During every blasting-off action, new, rough and porous surfaces are created, so that the removal of the deposits is also possible where the surface is already vitrified. Even after a brief treatment (a few seconds up to a few minutes), virtually metallically bright surfaces, which are freed of the deposits, can be restored in the orifice region of the feed nozzles or feed pipes. The object set at the beginning can also be achieved in that the vaporous medium is applied to the deposits in the direction of flow of the exhaust gases inside the feed nozzles or the feed pipes starting with that margin of the deposits which is the front margin in the direction of flow of the exhaust gases inside the feed nozzles or the feed pipes. It is critically important in this case that the vaporous medium, after it penetrates into the pores of the deposits, undergoes a rapid increase in volume, which is the case when the vaporous medium is water vapour. When water vapour is used, a longer treatment time is to be expected (a few minutes up to about 1 hour), since the increase in the specific volume during the temperature increase is distinctly less than, for example, during the use of water.

The application of the medium in the direction of flow of the exhaust gases inside the feed nozzles and in particular at the front margin of the deposits has the advantage that the medium, preferably water, reaches deposits which lie in the interior of the feed nozzle or the feed pipe and which still have a rough and porous surface, because they are better protected against the heat irradiation from the furnace by the feed nozzle or the feed pipe than deposits on the outside of the feed nozzle or the feed pipe, where vitrification of these deposits occurs on account of the intense heat effect. The medium, starting at a point where it can still penetrate easily into the deposits, can therefore start with the blasting action referred to, which then continues in the direction towards the orifice of the feed nozzle or the feed pipe up to the outside of the feed nozzle or the feed pipe.

By feeding the liquid medium by means of a feed nozzle in droplet form, the droplets having such a small size that the medium is sprayed, uniform wetting of the surface of the deposits with relatively low consumption of medium is achieved. At the same time, the discharge of excess medium from the feed nozzles or the feed pipes is largely avoided, so that impairment of the combustion in the furnace due to excessive quantities of discharging medium does not occur. It is particularly advantageous if the liquid medium is applied to the deposits in a finely distributed manner as a droplet mist.

In order to achieve uniform wetting of the deposits, it is expedient for the medium to be fed concentrically to the feed nozzle or the feed pipe.

Tests have shown that it is advantageous if the water is fed in the form of a conical screen. Here, the cone angle of the medium screen can be adjusted between 10° and 180°.

On account of the blasting action referred to, which is exerted inside the pores of the deposits by the liquid or vaporous medium or the water or the water vapour on account of an increase in volume which takes place very rapidly, a high water or steam pressure, as is to be achieved, for example, with high-pressure cleaners or by the use of the high-pressure steam generated in the steam boiler, is not necessary. It is therefore sufficient if the medium pressure, in particular the water pressure, corresponds to the pressure of a public water-supply network and is preferably around 6 bar. It is advantageous if the pressure and the quantity as well as the feed time and the period between two medium-feed phases are controllable.

An arrangement for carrying out the method is characterized by a lance which has a medium connection and can be inserted into the interior of a feed nozzle or a feed pipe for recirculated exhaust gas of a firing installation, the lance having a nozzle head at its front free end.

In most cases, the use of the invention does not require any particular additional expenditure, since installations in existence up to now, in the rear region of the feed nozzles or feed pipes, have connection pieces which lie in the axial direction of the latter and are intended for the insertion of rods, in order to remove the deposits by means of these rods. The lances can be inserted via these connection pieces into the interior of the feed nozzles or feed pipes. The formation of a nozzle head at the free end of the lance allows the medium to be applied to the deposits in a finely divided manner. Here, it is in turn advantageous if the spray angle of the nozzle head can be adjusted in order to be able to adapt the medium screen formed to the existing conditions.

If, in a further refinement of the invention, the lance is held in the interior of the feed nozzle or the feed pipe in such a way as to be displaceable in its longitudinal direction, adaptation of the medium discharge to the respective points at which the deposits are located is possible. In particular, it is possible for the medium discharging from the nozzle head to follow up the advancing cleaning action inside the feed nozzle.

So that this cleaning operation can be automated and thus used in accordance with the necessary time intervals observed, it is advantageous if, in a development of the invention, a controllable valve device is provided in the feed line to the lance, which valve device is connected to a control device in order to open and shut off the medium feed, to control the medium pressure and the medium quantity, and to control the opening times and the intervals between two opening phases. With this valve device and a control device connected thereto, it is then possible to set the duration of the cleaning and the time intervals between two cleaning operations as well as the pressure and the quantity in accordance with the respective conditions.

Figure 2:
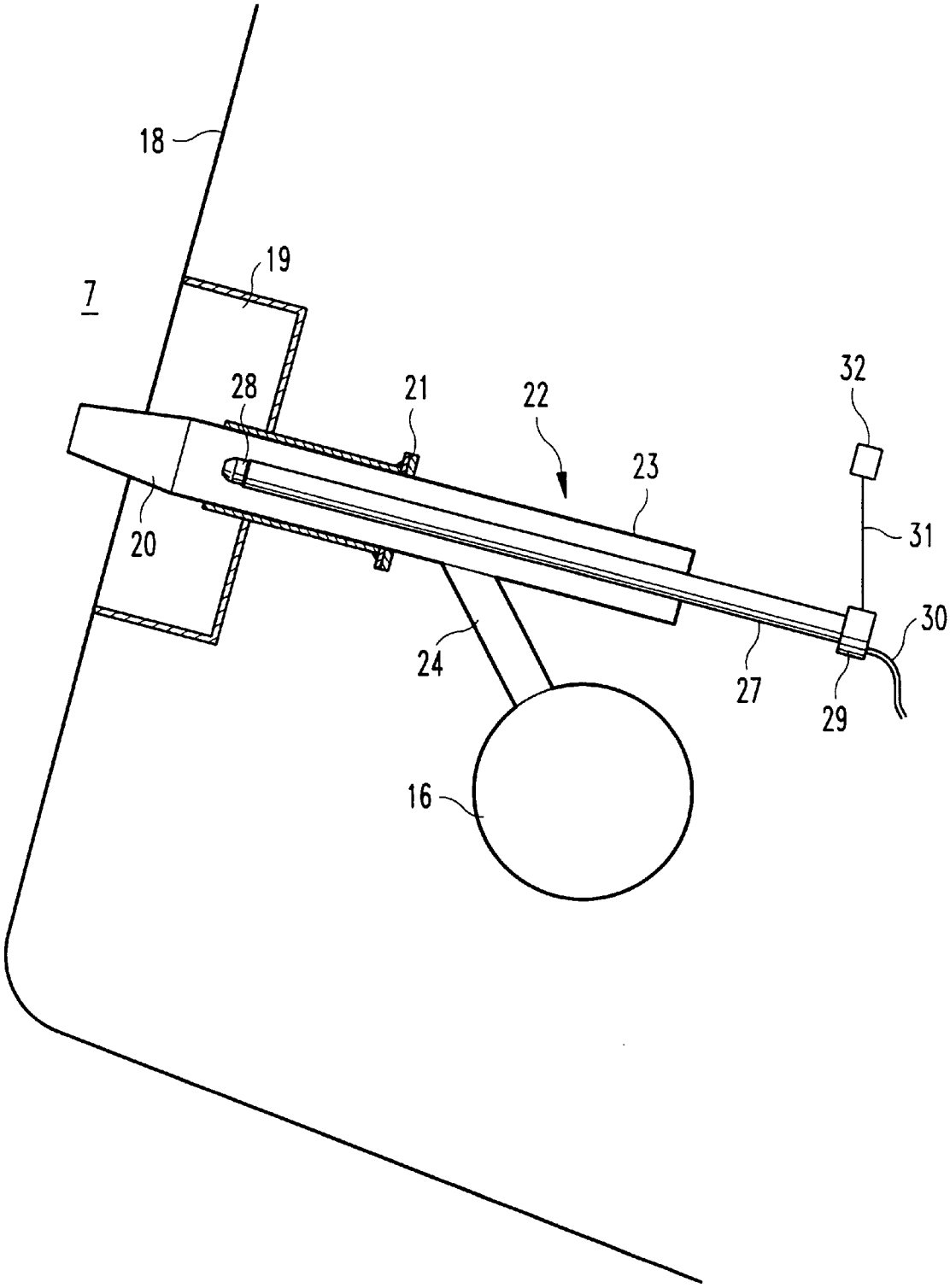
Figure 3:
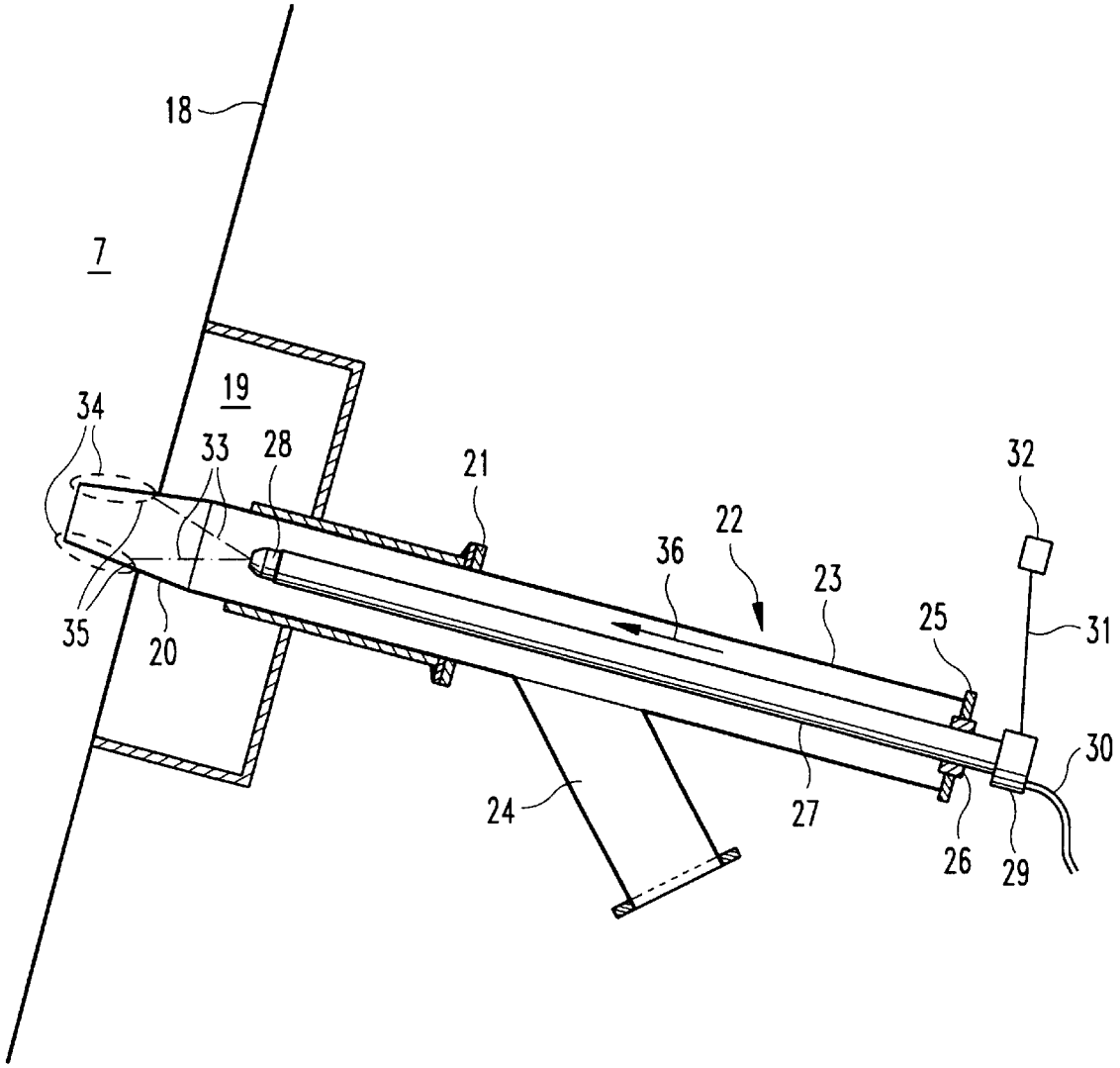

The invention is explained in more detail below with reference to an exemplary embodiment shown in the drawing, in which:

FIG. 1: shows a section through a schematically shown firing installation having feed nozzles for recirculated exhaust gas;

FIG. 2: shows an enlarged detail of a wall of a furnace with inserted feed nozzles; and FIG. 3: shows a section through a feed nozzle having a cleaning arrangement according to the invention on an enlarged scale.

FIG. 1 shows a firing installation having a delivery hopper 1 with adjoining delivery chute 2 for the delivery of the combustible material to a delivery table 3, on which charging plungers 4 are provided in order to deliver the combustible material coming from the delivery chute onto a firing grate 5. An apparatus designated overall by 6 and intended for feeding primary combustion air is provided below the firing grate 5. Located above the firing grate 5 is a furnace 7 which in the front part merges into an exhaust-gas flue 8, adjoining which are a waste-heat boiler 9 and an exhaust-gas cleaning system, consisting of a reactor 10, i.e. a chemical gas-cleaning apparatus, and a filter 11.

Downstream of this exhaust-gas cleaning system, exhaust gas is drawn off for re-introduction into the furnace. For this purpose, a suction opening 12 is provided in the outlet line of the filter 11, and starting from this suction opening 12 is a suction line 13, into which a fan 14 is inserted. Connected to the pressure side of the fan is a line 15, which feeds the drawn-off exhaust-gas quantity to a ring line 16, from which so-called secondary air nozzles 17 are fed, via which the drawn-off exhaust gas is fed again to the furnace 7.

As can be seen from FIGS. 2 and 3, a feed nozzle or a feed pipe 20 is inserted in the wall 18 of the furnace 7 inside a niche 19 of the latter, the feed nozzle 20 being connected via a flanged joint 21 to a pipe divider, which is designated overall by 22. The pipe divider has, on the one hand, a pipe 23, which is oriented in alignment with the feed nozzle 20, and a further pipe 24, which is connected to the ring line 16 for the recirculated exhaust gas. Provided at the end of the pipe 23 in alignment with the feed nozzle 20 is a cap 25, in the centre of which a holding device 26 for a lance 27 is provided. The holding device 26 is able to accommodate the lance 27 in such a way that the latter is displaceable in its longitudinal direction. A nozzle head 28 is provided at the front end of the lance 27. Arranged at the rear end of the lance 27 opposite the nozzle head 28 is a valve device 29, on which a water-feed line in the form of a hose 30 is flange-mounted. The valve device 29 is connected via a line 31 to a control device 32, which is able to control the feeding of water to the lance 27 with regard to the pressure and quantity and also shut off and open the valve device 29, in which case the time intervals between the opening phases and the length of the opening phases can be adjusted by the control device 32.

The nozzle head 28 provided at the front end of the lance 27 enables water to be sprayed out in the form of a conical water screen, the cone angle being adjustable. This water screen is indicated by chain-dotted lines in FIG. 3 and is provided with the reference numeral 33. Indicated by dotted lines 34 are deposits, which appear both in the interior of the feed nozzle and on its outside when exhaust gas is blown in from the feed nozzle 20 into the furnace 7. The period in which such deposits form depends on the composition of the exhaust gas and also on whether only exhaust gas or exhaust gas mixed with ambient air is directed into the furnace 7 via the feed nozzles 20.

To remove these deposits 34, water is now introduced via the lance 27, a start being made at that margin 35 of the deposits which is the front margin in the direction of flow of the exhaust gases. The direction of flow of the exhaust gases is identified by the arrow 36. The water which is sprayed on now penetrates into the porous mass of the deposits 34 and is abruptly vaporized on account of the intense heat irradiation which penetrates from the furnace 7 into the feed nozzle, so that the deposits 34 are blasted off from the wall of the feed nozzle 20 from the inside outwards. New, rough, that is to say, porous, fracture areas, into which the water can penetrate especially effectively, are created in the process by the blasting.

What is claimed is:

1. A method for removing deposits in and on a surface of a feed nozzle or feed pipe of a firing installation during normal operation of the firing installation, on which these deposits collect as a result of recirculated exhaust gas which is recirculated to a furnace, wherein a liquid medium is applied to the deposits, comprising:

spraying the liquid medium in droplet form onto the deposits on the surface, the spraying occurring in the direction of flow of the exhaust gases toward the furnace and inside the feed nozzle or feed pipe, the volume and pressure of the sprayed liquid medium being so as to allow normal operation of the firing installation during said spraying.

2. The method according to claim 1, characterized in that the liquid medium is applied to the deposits in a finely distributed manner as a droplet mist.

3. A method for removing deposits in and on a surface of a feed nozzle or a feed pipe of a firing installation during normal operation of the firing installation, on which these deposits collect as a result of recirculated exhaust gas which is recirculated to a furnace, wherein a vaporous medium is applied to the deposits, comprising:

applying the vaporous medium to the deposits in the direction of flow of the exhaust gases toward the furnace and inside the feed nozzle or the feed pipe, the volume and pressure of the applied vaporous medium so as to allow normal operation of the firing installation during said applying.

4. The method according to claim 1, characterized in that the liquid medium is water.

5. Method according to claim 3, characterized in that the vaporous medium is water vapour.

6. Method according to claim 1, characterized in that the medium is fed concentrically to the feed nozzle or the feed pipe.

7. Method according to claim 1, characterized in that the medium is fed in the form of a conical screen.

8. Method according to claim 7, characterized in that the cone angle of the medium screen can be adjusted between 10° and 180°.

9. The method according to claim 1, further comprising:

selectively controlling at least one of the medium pressure, the medium quantity, the feed time and the period between two medium-feed phases.

10. An apparatus for carrying out the method according to claim 1, characterized by a lance (27), which has a medium connection and can be inserted into the interior of a feed nozzle (20) or a feed pipe for recirculated exhaust gas of a firing installation, the lance (27) having a nozzle head (28) at its front free end.

11. The apparatus according to claim 10, characterized in that the spray angle of the nozzle head (28) can be adjusted.

12. The apparatus according claim 10, characterized in that the lance (27) is held (26) in the interior of the feed nozzle (20) or the feed pipe in such a way as to be displaceable in its longitudinal direction.

13. Arrangement according to claim 10, characterized in that a controllable valve device (29) is provided in the feed line (30) to the lance (27), which valve device (29) is connected to a control device (32) in order to open and shut off the medium feed, to control the medium pressure and the medium quantity, and to control the opening times and the intervals between two opening phases.

14. Method according to claim 2, characterized in that the liquid medium applied as a droplet mist is water.

15. The method of claim 1 wherein the deposits have a front margin located farthest from the furnace, and the spraying begins at the front margin.

16. The method of claim 3 wherein the deposits have a front margin located farthest from the furnace, and the applying begins at the front margin.

17. The method of claim 3 wherein the vaporous medium is fed concentrically to the feed nozzle or the feed pipe.

18. The method of claim 3 wherein the medium is fed in the form of a conical screen.

19. The method according to claim 18, wherein the cone angle of the medium screen can be adjusted between 10° and 180°.

20. The method according to claim 3, further comprising:

selectively controlling at least one of the medium pressure, the medium quantity, the medium feed time and the period between two medium-feed phases.

21. An apparatus for carrying out the method of 3, characterized by a lance (27), which has a medium connection and can be inserted into the interior of a feed nozzle (20) or a feed pipe for recirculated exhaust gas of a firing installation, the lance (27) having a nozzle head (28) at its front free end.

22. The apparatus of claim 21, wherein the spray angle of the nozzle head (28) can be adjusted.

23. The apparatus of claim 21, wherein the lance (27) is held (26) in the interior of the feed nozzle (20) or the feed pipe in such a way as to be displaceable in its longitudinal direction.

24. The apparatus of claim 21, further comprising:

a controllable valve device (29) located in the feed line (30) to the lance (27), the valve device (29) operatively connected to a control device (32), thereby to provide selectable control over opening and shutting off the medium feed, the medium pressure and the medium quantity, the opening times, and the intervals between two opening phases.

* * * * *